US009523140B2

(12) United States Patent
Nie et al.

(10) Patent No.: US 9,523,140 B2
(45) Date of Patent: Dec. 20, 2016

(54) HEAT TREATMENT PROCESS OF HIGH-MG ER-MICROALLOYED ALUMINUM ALLOY COLD-ROLLED PLATES RESISTANT TO INTERGRANULAR CORROSION

(71) Applicant: BEIJING UNIVERSITY OF TECHNOLOGY, Beijing (CN)

(72) Inventors: Zuoren Nie, Beijing (CN); Kunyuan Gao, Beijing (CN); Shengping Wen, Beijing (CN); Hui Huang, Beijing (CN); Rui Shao, Beijing (CN)

(73) Assignee: Beijing University of Technology, Beijing (CN)

( * ) Notice: Subject to any disclaimer, the term of this patent is extended or adjusted under 35 U.S.C. 154(b) by 547 days.

(21) Appl. No.: 13/978,678

(22) PCT Filed: Mar. 13, 2013

(86) PCT No.: PCT/CN2013/072523

§ 371 (c)(1),
(2) Date: Jul. 8, 2013

(87) PCT Pub. No.: WO2013/135175

PCT Pub. Date: Sep. 19, 2013

(65) Prior Publication Data

US 2014/0053959 A1 Feb. 27, 2014

(30) Foreign Application Priority Data

Mar. 13, 2012 (CN) ..... 2012 1 0065948

(51) Int. Cl.
*C22F 1/047* (2006.01)
*C22F 1/00* (2006.01)

(52) U.S. Cl.
CPC *C22F 1/047* (2013.01); *C22F 1/00* (2013.01)

(58) Field of Classification Search
None
See application file for complete search history.

(56) References Cited

FOREIGN PATENT DOCUMENTS

CN 1851019 A 10/2006
CN 101403062 A 4/2009
(Continued)

OTHER PUBLICATIONS

Chang-Hua et al., "Corrosion Behavior and Microstruture of Er Containing 5083 and 5A06 Al—Mg Alloys", Corrosion & Protection, vol. 32, No. 2, pp. 94-112 (2011).
(Continued)

*Primary Examiner* — Jessee Roe
*Assistant Examiner* — Jenny Wu
(74) *Attorney, Agent, or Firm* — Bret E. Field; Rudy J. Ng; Bozicevic, Field & Francis LLP

(57) ABSTRACT

A heat treatment process of high-Mg Er-containing aluminum alloy cold-rolled plates resistant to intergranular corrosion is disclosed, which belongs to the field of non-ferrous metals. The mass percentage of each component of high-Mg Er-containing aluminum alloy heat-rolled plates is, respectively, 5.8%-6.8% of Mg, 0.4%-0.8% of Mn, 0.15%-0.25% of Er, 0.15%-0.25% of Zr, the unavoidable impurities content being less than 4%, the balance being Al. The alloy hot-rolled plates are cold-rolled until the final cold deformation being 75%-90% after the intermediate annealing; the aluminum alloy cold-rolled plates undergo a stabilization annealing at the annealing temperature of 235° C. to 245° C. for 3.5-4 hours, and then is cooled in air to room temperature. This process significantly improves the resistance to intergranular corrosion while it does not reduce the strength of the alloy significantly.

2 Claims, 5 Drawing Sheets

(56) References Cited

FOREIGN PATENT DOCUMENTS

| | | | |
|---|---|---|---|
| CN | 101403080 | A | 4/2009 |
| CN | 101497975 | A | 8/2009 |
| CN | 101831578 | A | 9/2010 |
| CN | 102011072 | A | 4/2011 |
| CN | 102586707 | A | 7/2012 |
| JP | 2009235477 | A | 10/2009 |

OTHER PUBLICATIONS

Junlin et al., "Effects of Annealing on Microstructure and Mechanical Properties of Cold-Rolled Al—Mg—Mn—Zr—Er Alloy", Chinese Journal of Rare Metals, vol. 35, No. 5, pp. 652-656 (2011).

HEAT TREATMENT PROCESS OF HIGH-MG ER-MICROALLOYED ALUMINUM ALLOY COLD-ROLLED PLATES RESISTANT TO INTERGRANULAR CORROSION

TECHNICAL FIELD

The invention belongs to the technical field of non-ferrous metals, and in particular, relates to stabilization annealing process for improving the resistance to intergranular corrosion of high-Mg Er-microalloyed aluminum alloy cold-rolled plates. The process significantly improves the resistance to intergranular corrosion while do not reduce the strength of the alloys significantly.

BACKGROUND

Al—Mg-based alloys are widely used in the fields of aviation, aerospace and transportation etc. The improvement of the strength and the corrosion resistance of the alloys has been the key issue of Al—Mg-based alloys research. Al—Mg alloys belong to non-heat-strengthened wrought aluminum alloy. The main methods for strengthening rely on magnesium (Mg) atom solid solution strengthening and cold-work hardening. The strength of Al—Mg alloys is improved with the increase of Mg content. However, when the mass percent of Mg exceeds 3.5%, age softening which lead the decrease of strength will occur during the long-term service as the decrease of the supersaturated Mg in the matrix even at room temperature, and Al—Mg alloys are easy to precipitate the beta phase ($Mg_2Al_3$) continuously along the grain boundaries to form the intergranular films which result in serious intergranular corrosion and stress corrosion. Cold-work hardening could improve the strength of the alloys mainly by cold working, but the greater the amount of cold deformation will be, the higher deformation energy will store, and the thermodynamics of the alloys is more unstable. Therefore stabilization annealing treatment must be carried out on the higher Mg content of cold deformed Al—Mg alloys to make its mechanical properties remain stable, and control the location and the distribution of beta phase to make the beta phase not continuously precipitate along the grain boundaries so as to improve the long-term resistance to intergranular corrosion of the alloys.

As the above two methods for strengthening are limited, the Al—Mg-based alloys are further researched and developed in order to meet the ever-increasing demands of the mechanical properties in the fields of ships and vessels, etc. The study indicated that the micro-alloying can effectively improve the mechanical properties of the alloys. Recent years' studies found that by adding trace Er into aluminum alloy, the grains can be refined, and finely dispersed precipitates which pin dislocations can be formed in the matrix, so as to increase the mechanical properties of the alloys.

The strength of Al—Mg-based alloys could be relatively high and stable, and their resistance to intergranular corrosion is good by the micro-alloying of Al—Mg-based alloys and the combination of the appropriate cold deformation and the stabilization annealing process. The excellent comprehensive performance of Al—Mg-based alloys can ensure the stabilization of the long-term operation and security during application process. There are many studies of the heat treatment process of the alloys such as 5052, 5754, 5083, especially the state of H116, H2N, and H3N. But the stabilization annealing process of the high-Mg Er-containing aluminum alloy plates of large cold deformation is rarely reported.

SUMMARY OF THE INVENTION

The objective of the present invention is to solve the problem of the poor resistance to the long-term intergranular corrosion of high Mg Al—Mg-based alloys by stabilization annealing heat treatment so that the alloys have good resistance to long-term intergranular corrosion and keep high strength at the same time.

The present invention provides a heat treatment process for the high-Mg Er-containing (i.e. high-Mg Er-microalloyed) aluminum alloy cold-rolled plates with the resistance to intergranular corrosion, wherein the high-Mg Er-containing aluminum alloy hot-rolled plates have, for the mass percentage of each component, Mg 5.8%-6.8%, Mn 0.4%-0.8%, Er 0.15%-0.25%, Zr 0.15%-0.25%, the unavoidable impurities being less than 4%, the remaining being Al, the process comprising the following steps:

(1) the hot-rolled plates are cold rolled (or cold-finished) after the intermediate annealing, the final cold deformation degree being 75%-90%;

(2) the high-Mg Er-containing aluminum alloy cold-rolled plates obtained from Step (1) undergo a stabilization annealing at the temperature between 235° C. to 245° C. for 3.5-4 hours, and is cooled in air to room temperature subsequently.

The intermediate annealing process of Step (1) is preferably an annealing process of 350° C./2 h, followed by the cold rolling process. The cold rolling process is preferably controlled so that the compression deformation degree each time is 10%-25%, and the final cold deformation degree is 75%-90%.

The advantages of the technical solutions of the present invention lie in that:

The present invention selects the alloy's composition, the addition of the trace elements Mn, Zr, and Er improves the stability of the organization and properties. Addition of trace Er makes the alloy precipitate small secondary phase $Al_3Er$ in the subsequent heating process, which pin dislocations and refine the grains, and then enhance the effect of cold work hardening of the alloy.

The residual stress of the alloy after cold deformation will be eliminated, and the dislocation density is reduced, while the strength of the alloy is maintained high and stable by annealing high-Mg Er-containing aluminum alloy cold-rolled plates in the temperature range of 100° C. and 245° C., at intervals of 20° C. or 25° C., and the annealing treatment at the same annealing temperature is taken for different periods. More importantly, on this basis the present invention further defines the annealing temperature and time to avoid continuous precipitation of β-phase at the grain boundaries, reducing the electrical potential difference between the interior of the grains and the grain boundaries in the alloy, and thereby significantly improves the resistance to intergranular corrosion of the alloy and maintain strong alloy strength at the same time.

In summary, the alloy has good resistance to long-term intergranular corrosion while it maintains strong strength, ensuring the stabilization of operation in the long-term service and the security of application, by the stabilization annealing process of high-Mg Er-containing aluminum alloy cold-rolled plates of the present invention, which is a promising heat treatment process.

The invention will be further explained below in conjunction with the accompanying drawings and the embodiments.

DETAILED DESCRIPTION OF THE EMBODIMENTS

Comparative Example 1

1) A 20 mm thick high-Mg Er-containing aluminum alloy hot-rolled plates are exemplified, which has a chemical composition of Mg 6.4%, Mn 0.4%, Er 0.25%, Zr 0.2%, inevitable impurities content <4%, and the balance is Al. The hot-rolled plates undergo an intermediate annealing at 350° C. for 2 hours, and then are cooled in air to room temperature.

2) The high-Mg Er-containing aluminum alloy plates obtained from Step 1) undergo cold-finish rolling for several times, the compression deformation degree is controlled to be about 10%-25% each time, and the cold deformation degree is 75%-90%.

Figure 1:
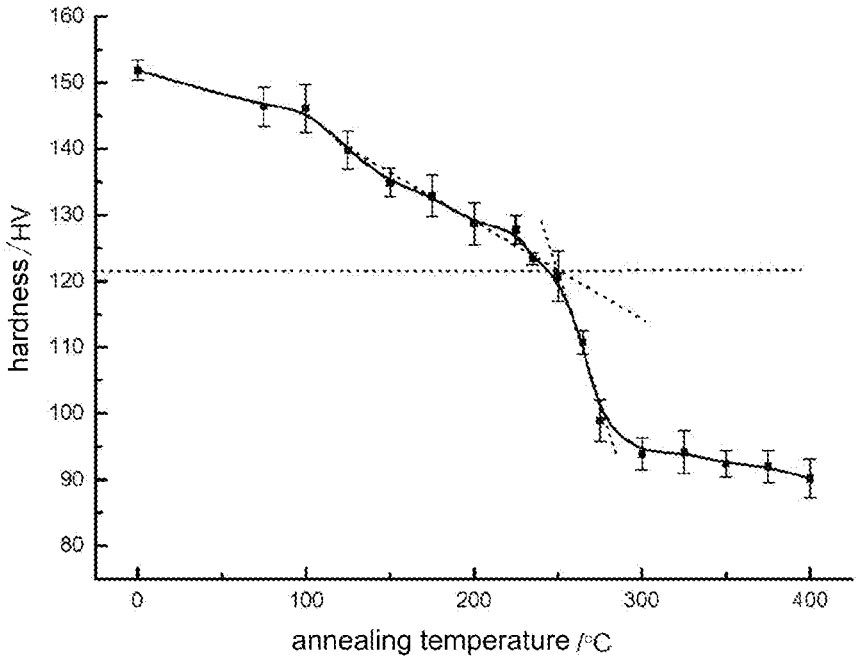
FIG. 1 is a graph representing the relationship between the microhardness and annealing temperature of the high-Mg Er-containing aluminum alloy cold-rolled plates.

3) The cold-rolled plates obtained from step 2) are annealed at different temperatures for 1 hour using the box-type annealing furnace (temperature error is ±5° C.), and the alloy cold-rolled plates are cooled in air to room temperature subsequently. The change of the microhardness of the cold-rolled plates as a function of annealing temperature is tested, as shown in FIG. 1. As can be seen from the hardness curve in FIG. 1, the recrystallization starting temperature of the alloy is 250° C., and the hardness corresponding to 250° C. annealed state of the alloy is 121 HV. In order to ensure the mechanical properties of the alloy, the cold-rolled plates are annealed at a selected temperature below 250° C. in the following examples.

Comparative Example 2

Step 1) and step 2) are same as those in Comparative Example 1.

Figure 2:
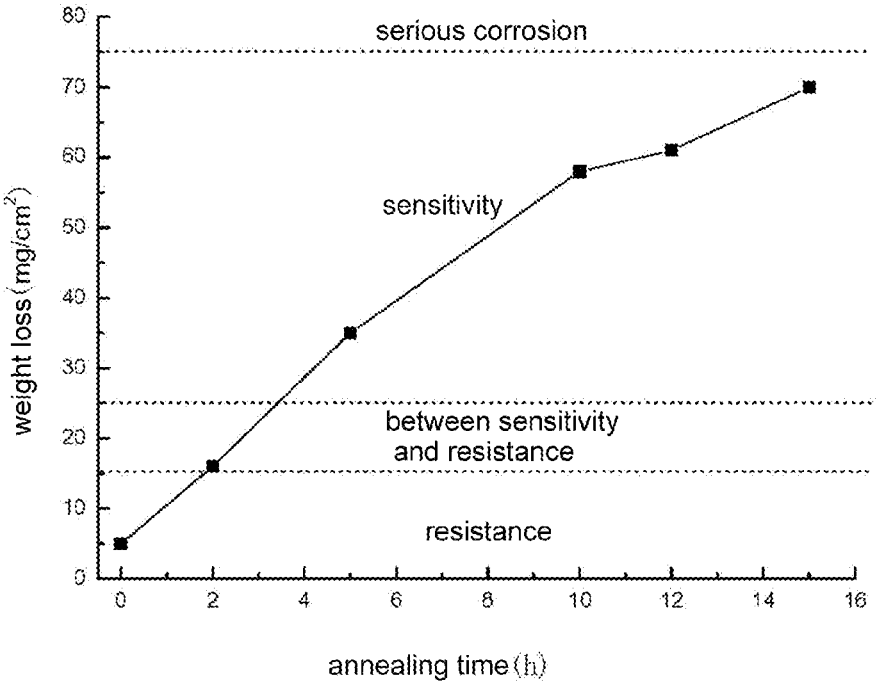
FIG. 2 is a graph representing the weight loss change of the high-Mg Er-containing aluminum alloy cold-rolled plates for different annealing time at 100° C.

3) The cold-rolled plates are annealed at 100° C. for different time. According to the standard of American Society for Testing Materials ASTM G67 (nitric acid immersion weight loss method), an experiment of intergranular corrosion is taken for the cold rolling state and different annealing states, and the intergranular corrosion susceptibility of the materials is assessed by the alloy unit area weight loss before and after immersion. The curve of the change of the unit area weight loss with annealing time is shown in FIG. 2.

Comparative Example 3

Step 1) and step 2) are same as those in Comparative Example 1.

Figure 3:
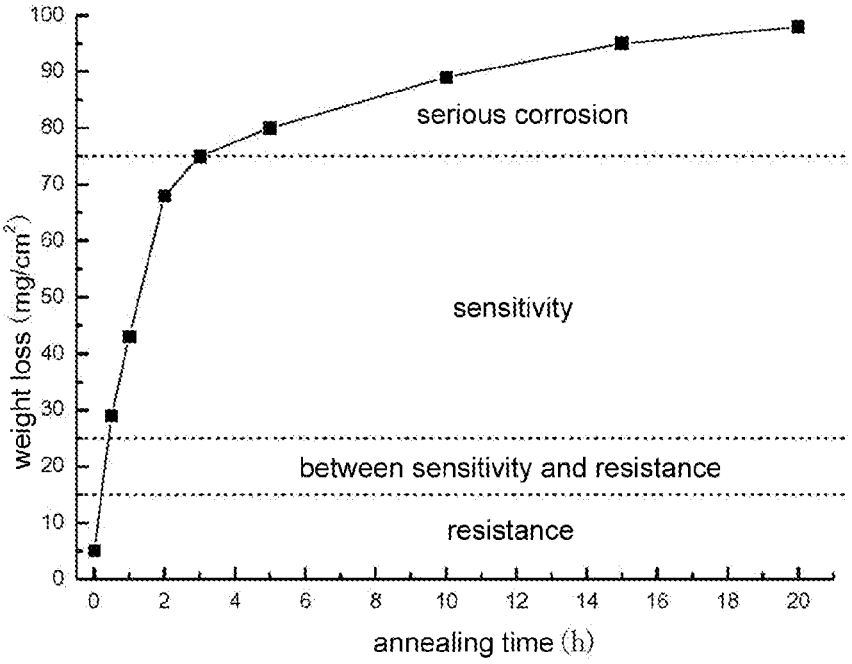
FIG. 3 is a graph representing the weight loss change of the high-Mg Er-containing aluminum alloy cold-rolled plates for different annealing time at 125° C.

3) The alloy cold-rolled plates are annealed at 125° C. for different time. According to the standard of American Society for Testing Materials ASTM G67 (nitric acid immersation weight loss method), an experiment of intergranular corrosion is taken for different annealing states of the alloy at 125° C. The curve of the change of the unit area weight loss of the alloy with annealing time is shown in FIG. 3.

Comparative Example 4

Step 1) and step 2) are same as those in Comparative Example 1.

Figure 4:
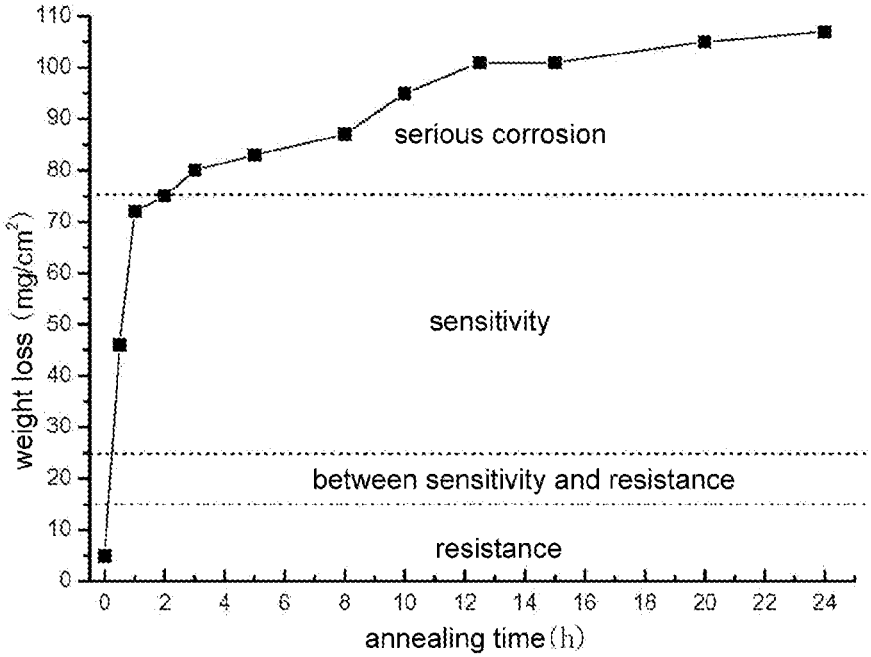
FIG. 4 is a graph representing the weight loss change of the high-Mg Er-containing aluminum alloy cold-rolled plates for different annealing time at 150° C.

3) The alloy cold-rolled plates are annealed at 150° C. for different time. According to the standard of American Society for Testing Materials ASTM G67 (nitric acid immersation weight loss method), an experiment of intergranular corrosion is taken for different annealing states of the alloy at 150° C. The curve of the change of the unit area weight loss of the alloy with annealing time is shown in FIG. 4.

Comparative Example 5

Step 1) and step 2) are same as those in Comparative Example 1.

Figure 5:
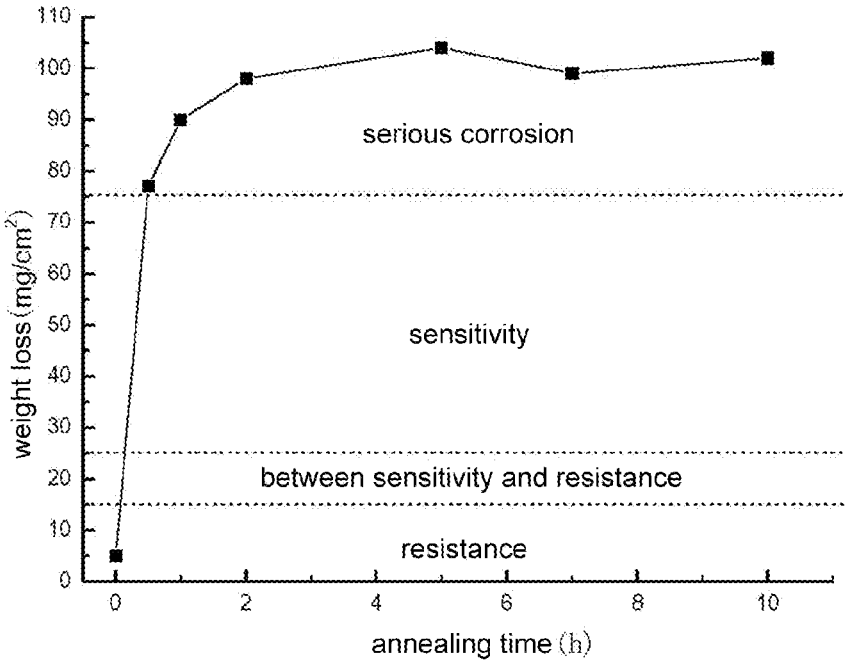
FIG. 5 is a graph representing the weight loss change of the high-Mg Er-containing aluminum alloy cold-rolled plates for different annealing time at 175° C.

3) The cold-rolled plates are annealed at 175° C. for different time. According to the standard of American Society for Testing Materials ASTM G67 (nitric acid immersation weight loss method), an experiment of intergranular corrosion is taken for different annealing states of the alloy at 175° C. The curve of the change of the unit area weight loss of the alloy with annealing time is shown in FIG. 5.

Comparative Example 6

Step 1) and step 2) are same as those in Comparative Example 1.

Figure 6:
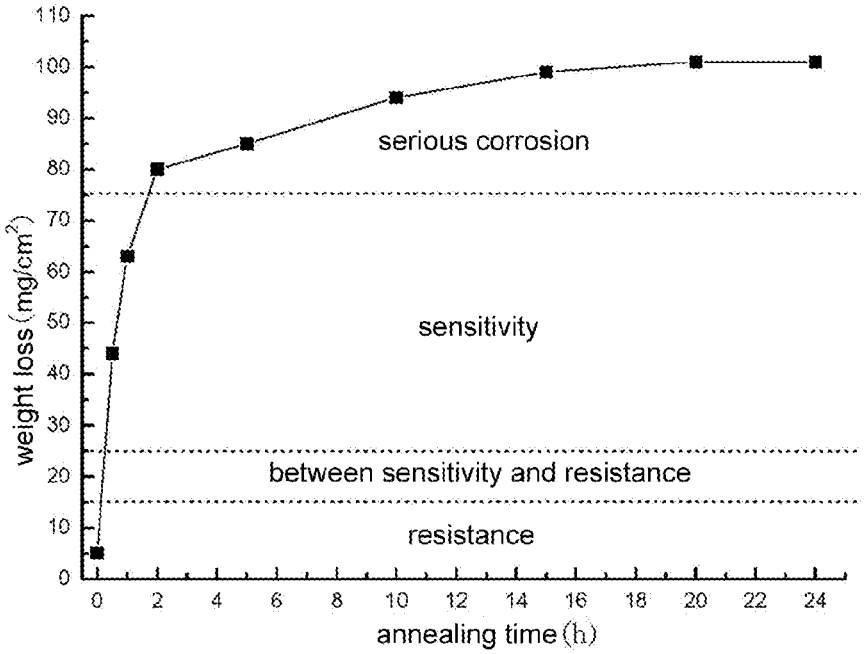
FIG. 6 is a graph representing the weight loss change of the high-Mg Er-containing aluminum alloy cold-rolled plates for different annealing time at 200° C.

3) The cold-rolled plates are annealed at 200° C. for different time. According to the standard of American Society for Testing Materials ASTM G67 (nitric acid immersation weight loss method), an experiment of intergranular corrosion is taken for different annealing states of the alloy at 200° C. The curve of the change of the unit area weight loss of the alloy with annealing time is shown in FIG. 6.

Comparative Example 7

Step 1) and step 2) are same as those in Comparative Example 1.

Figure 7:
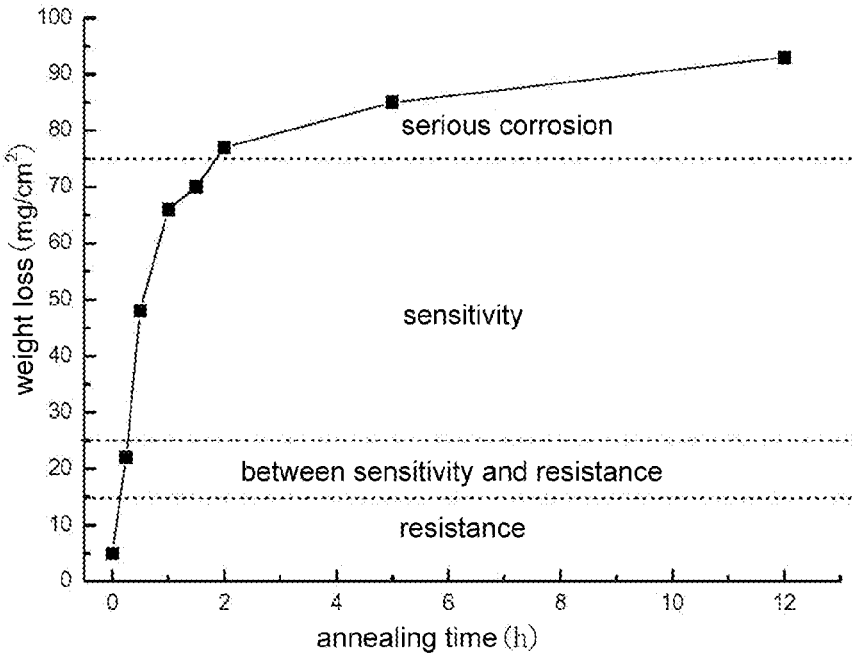
FIG. 7 is a graph representing the weight loss change of the high-Mg Er-containing aluminum alloy cold-rolled plates for different annealing time at 220° C.

3) The cold-rolled plates are annealed at 220° C. for different time. According to the standard of American Society for Testing Materials ASTM G67 (nitric acid immersation weight loss method), an experiment of intergranular corrosion is taken for different annealing states of the alloy at 220° C. The curve of the change of the unit area weight loss of the alloy with annealing time is shown in FIG. 7.

Example 1

Step 1) and step 2) are same as those in Comparative Example 1.

Figure 8:
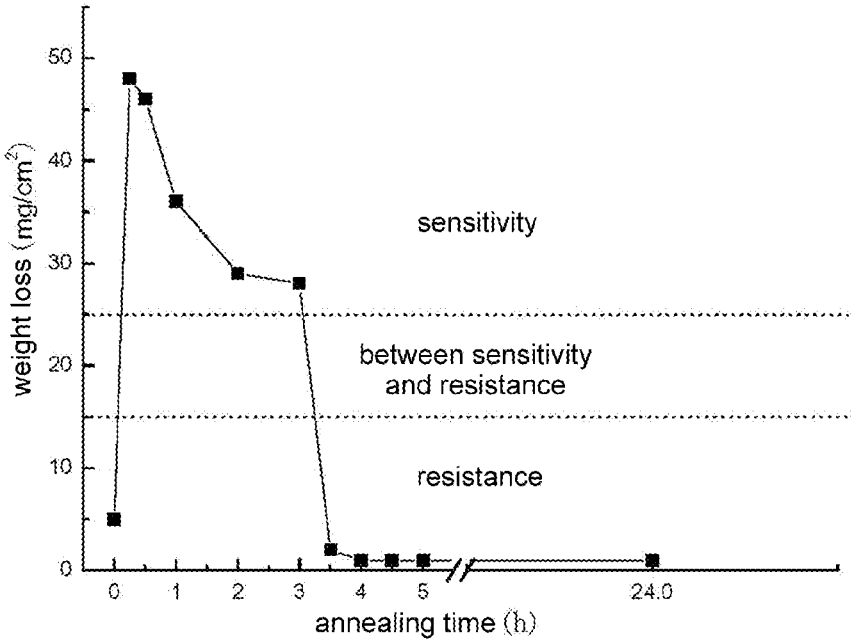
FIG. 8 is a graph representing the weight loss change of the high-Mg Er-containing aluminum alloy cold-rolled plates for different annealing time at 240° C.

3) The cold-rolled plates are annealed at 240° C. for different time. According to the standard of American Society for Testing Materials ASTM G67 (nitric acid immersation weight loss method), an experiment of intergranular corrosion is taken for different annealing states of the alloy at 240° C. The curve of the change of the unit area weight loss of the alloy with annealing time is shown in FIG. 8.

As can be seen from FIG. 2 to FIG. 8, the alloy corrosion weight loss is increased with the increase of annealing time after the annealing treatment at 100° C.-220° C. and its resistance to intergranular corrosion is reduced. Compared with other annealing temperatures, the weight loss appears different trends at the annealing temperature of 240° C. In 0.5 hour of annealing, the weight loss is sharply increased to corrosion sensitive area and then decreased with the extension of time. After 3.5 hours of annealing, its weight loss is drastically reduced to 1 mg/cm$^2$ and stabilizes with the time to 24 hours, being in the intergranular corrosion resistive area, showing excellent resistance to intergranular corrosion.

Figure 9:
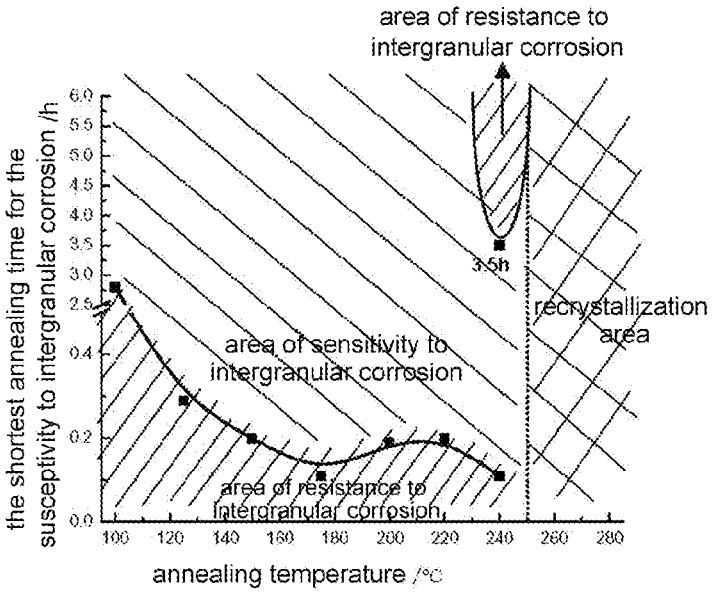
FIG. 9 is a diagram representing the relationship between annealing temperature and time regarding the susceptibility to intergranular corrosion of the high-Mg Er-containing aluminum alloy cold-rolled plates.

According to the results of intergranular corrosion tests after treatments with different annealing temperatures and different annealing time of FIG. 2 to FIG. 8, the temperature-time curve of intergranular corrosion sensitivity of high-Mg Er-containing aluminum alloy cold-rolled plates at different annealing states and the distribution chart of alloy intergranular corrosion resistive area, intergranular corrosion sensitive area and recrystallization area are drawn, as shown in FIG. 9. As can be seen from FIG. 9, the resistance to intergranular corrosion of the alloy after the annealing treatment at 150° C.-220° C. is significantly reduced. This temperature range is the alloy intergranular corrosion sensitizing temperature, so it should be avoided in the alloy heat treatment process and application. The resistance to intergranular corrosion at alloy 100° C. annealing state is slightly better than 150° C.-220° C. annealing states. The alloy still appears the sensitivity to intergranular corrosion when the annealing time is extended to three hours. However, the alloy appears a sensitivity to intergranular corrosion after a treatment of annealing at 240° C. for a very short annealing time (0.11 hours), but it is in the area of resistance to intergranular corrosion after the annealing time extending to 3.5-24 hours, showing excellent resistance to intergranular corrosion. It can be predicted from the experimental results that the alloy still has excellent resistance to intergranular corrosion if the annealing temperature is further increased (in the recrystallization region), but when the alloy recrystallized, the mechanical properties will be decreased obviously. Therefore 240° C. is the best stabilization temperature of the alloy. Since systematic error of temperature in the annealing furnace used in the examples is ±5° C., the best stabilization temperature interval of high-Mg Er-containing aluminum alloy cold-rolled plates with the resistance to intergranular corrosion according to the invention is 235° C. to 245° C.

Example 2

Step 1) and step 2) are same as those in Comparative Example 1.

Figure 10:
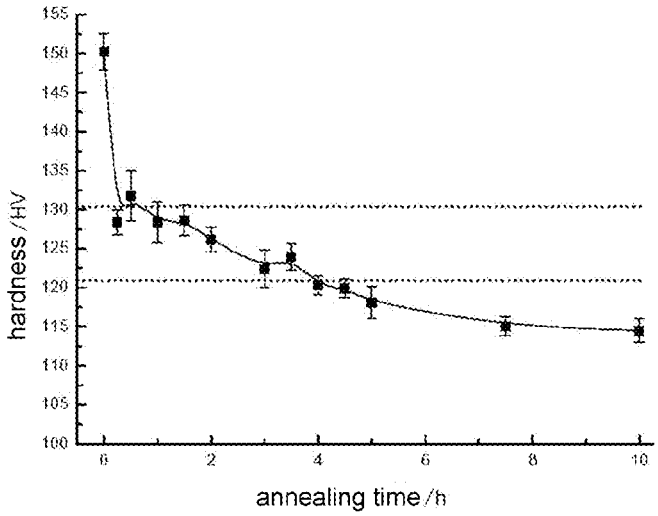
FIG. 10 is a graph representing the microhardness change of the high-Mg Er-containing aluminum alloy cold-rolled plates for different annealing time at 240° C.

3) The high-Mg Er-containing aluminum alloy cold-rolled plates are annealed at 240° C. for different time. The change of the microhardness of the cold-rolled plates at 240° C. as a function of annealing time is tested, as shown in FIG. 10. From the curve of hardness in FIG. 10, it can be seen that the hardness of the alloy is greatly reduced after the annealing at 240° C. for 0.25 hours, which is reduced to 130 HV from 150 HV, and is slowly reduced with the extension of annealing time and finally tends to stabilization. In order to ensure that the mechanical properties of the cold-deformed alloy after stabilization annealing at 240° C. remains at a high level, it is necessary to determine the stabilization annealing time. It can be seen from Comparative Example 1, the critical hardness value of the alloy cold-rolled when it starts recrystallization is 121 HV, corresponding to the hardness value of the annealed alloy at 240° C. for 4 hours, as shown in the dashed line in FIG. 10. Therefore, the period of 3.5-4 hours is the best stabilization annealing time of high-Mg Er-containing aluminum alloy cold-rolled plates with resistance to intergranular corrosion.

The best stabilization annealing process of the high-Mg Er-containing aluminum alloy plates with 75% to 90% cold deformation is annealing at the temperature interval of 235° C. to 245° C. for 3.5 to 4 hours, which significantly improves the alloy resistance to long-term intergranular corrosion and allows high mechanical properties of the alloy at the same time, which is benefit for the long-running stability and safety use of the products.

What is claimed is:

1. A heat treatment process of high-Mg Er-containing aluminum alloy cold-rolled plates resistant to intergranular corrosion, the mass percentage of each component of high-Mg Er-containing aluminum alloy hot rolled plates from which the cold-rolled plates are prepared being, respectively, 6.4% of Mg, 0.4% of Mn, 0.25% of Er, 0.2% of Zr, the unavoidable impurities content being less than 4%, the balance being Al, wherein the process is characterized by including the following steps:

(1) the high-Mg Er-containing aluminum alloy hot rolled plates are cold-rolled after an intermediate annealing, and the final cold deformation of the plates being 75%-90%; and (2) the high-Mg Er-containing aluminum alloy cold-rolled plates obtained from step (1) undergo a stabilization annealing at the temperature of 235° C. to 245° C. for 3.5-4 hours, and then are cooled in air to room temperature, wherein the high-Mg Er-containing aluminum alloy has a hardness of 120 HV to 130 HV and a weight loss of 1 mg/cm$^2$ as tested by American Society for Testing Materials (ASTM) G67.

2. The process according to claim 1, characterized in that the cold rolling follows the intermediate annealing at 350° C. for 2 hours, and the cold rolling is controlled so that a compression deformation each time is 10%-25%, and the final cold deformation amount is 75%-90%.

* * * * *